United States Patent [19]

Coffin

[11] 4,435,626

[45] Mar. 6, 1984

[54] PRESSURE RESPONSIVE SWITCH ACTUATING MECHANISM

[75] Inventor: Christopher J. Coffin, Milton, England

[73] Assignee: Alan Cobham Engineering Limited, London, England

[21] Appl. No.: 246,796

[22] Filed: Mar. 23, 1981

[30] Foreign Application Priority Data

Mar. 21, 1980 [GB] United Kingdom ..... 8009626
Jan. 27, 1981 [GB] United Kingdom ..... 8102443

[51] Int. Cl.[3] ..... H01H 35/40

[52] U.S. Cl. ..... 200/81.9 R; 200/81.9 M; 200/83 P; 200/34

[58] Field of Search ..... 200/34, 81 R, 81.4, 200/83 P, 83 L, 83 R, 83 S, 83 J, 83 T, 81.9 R, 81.9 M, 82 R, 82 E, 337; 335/61, 62

[56] References Cited

U.S. PATENT DOCUMENTS

| | | | |
|---|---|---|---|
| 2,738,397 | 3/1956 | Slonneger | 200/83 P |
| 2,900,915 | 8/1959 | Rowell | 200/83 P |
| 3,363,075 | 1/1968 | Jordan | 200/83 T |
| 3,588,403 | 1/1969 | Piret . | |
| 3,879,590 | 4/1975 | Kovacs | 200/83 P |

FOREIGN PATENT DOCUMENTS

| | | | |
|---|---|---|---|
| 671224 | 9/1963 | Canada | 200/83 T |
| 2824611 | 12/1979 | Fed. Rep. of Germany . | |
| 261270 | 5/1926 | United Kingdom . | |
| 1144992 | 3/1969 | United Kingdom . | |

*Primary Examiner*—G. P. Tolin
*Attorney, Agent, or Firm*—Edwin E. Greigg

[57] ABSTRACT

A pressure responsive reed switch operating mechanism comprises a magnet mounted on a rod which is fixed to a dashpot piston and which is spring urged against a movable stop. The location of the stop is controlled by a pressure responsive system comprising a fluid pressure servo motor, a buckling link, a lever and a coil spring. The stop is stationary and the magnet displaced from its switch actuating location until the predetermined switching pressure is established whereupon the coil spring yields and the buckling link buckles with a snap action so that the stop is moved rapidly away from the rod. The rod follows the stop slowly, due to the combined action of the dashpot and the spring, until it reabuts the stop whereby the magnet is moved into position to actuate the reed switch a predetermined time interval after establishment of the switching pressure. The buckling link snaps back to return the magnet promptly to its inoperative location when the working fluid pressure falls to a certain pressure below the switching pressure.

17 Claims, 2 Drawing Figures

PRESSURE RESPONSIVE SWITCH ACTUATING MECHANISM

Figure 1:
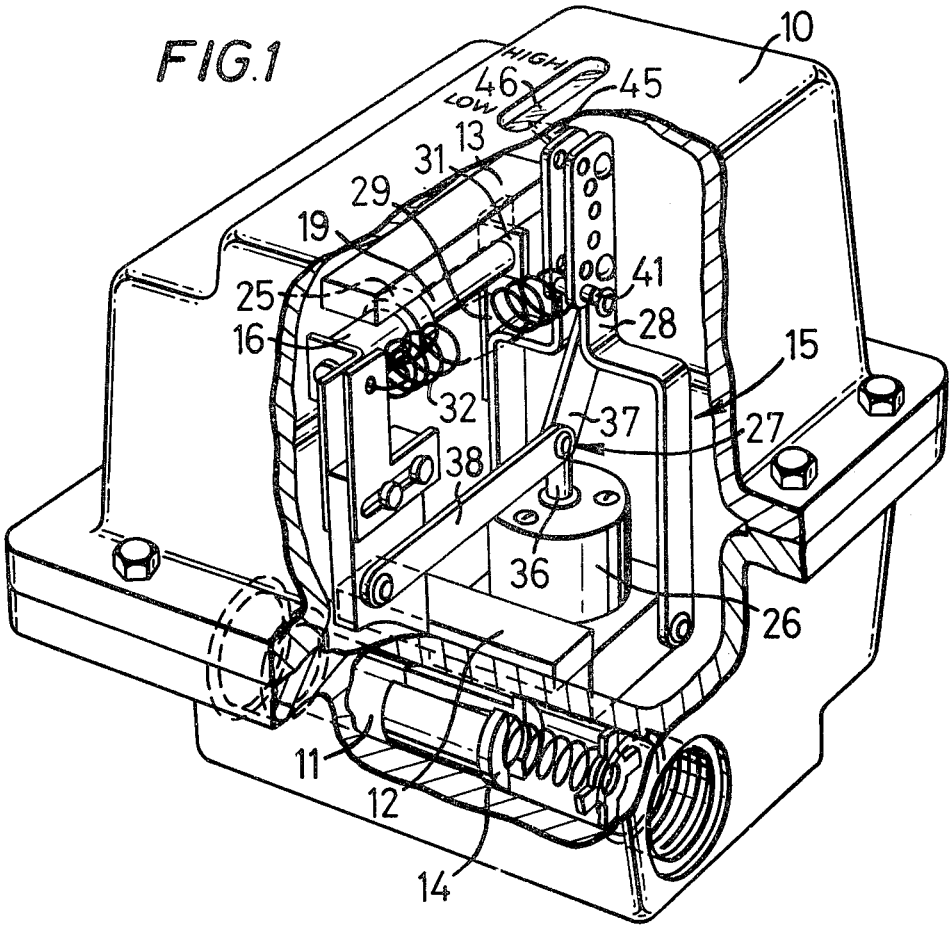

This invention relates to pressure responsive switch actuating mechanisms.

Pressure responsive switch actuating mechanisms have many applications. One such application is in a coal shearing machine as used in coal mines. Such machines incorporate a water pressure system for forming water spray for suppressing dust in the region of the cutters. A switch in the cutter driving power circuit is controlled by the pressure responsive switch actuating mechanism in such a way that the circuit is interrupted whilst the water pressure is being built up to the pressure necessary to form the spray and for a predetermined time interval after that pressure is established, the switch being operated automatically by the mechanism at the end of the time delay to make the circuit and drive the cutters, providing the water pressure necessary to form the spray has been maintained. Accordingly, on starting the machine, firstly the machine power is switched on but the cutters remain inoperative whilst the water pressure is being built up and for a predetermined time period (say seven seconds) after the water pressure to form the spray has been built up. Hence the spraying of water constitutes a warning to miners that the cutters are about to start automatically.

British Patent Specification Nos. 261,270 and 1,144,992 both disclose a pressure responsive switch actuating mechanism which includes a movable actuating element which is movable between an inoperative location and an operative location to actuate the switch, and a pressure responsive system including a movable stop against which the movable actuating element is normally urged, the pressure responsive system being operable to control movement of the movable actuating element by controlling location of the movable stop in accordance with a working pressure to which it is adapted to respond, there being a time delay mechanism which operates to delay movement of the switch actuating mechanism following movement of the movable stop. However such switch actuating mechanisms are not suitable for controlling a switch in the cutter driving power circuit of a coal shearing machine in order to interrupt that circuit whilst the water pressure is being built up to the required pressure and for a predetermined time interval after that pressure is established. In each case, the pressure responsive system is completely responsive to all pressure changes so that the location of the movable stop changes when the working pressure changes. This can lead to premature partial operation of the time delay mechanism and that may lead to an effective shortening of the time delay after the predetermined fluid pressure is established. Also, the length of the actual time delay can vary with the magnitude of the working pressure. Furthermore the switch actuating element of the mechanism disclosed in British Patent Specification No. 261,270 is adapted to actuate its respective switch during the time delay and not once that time delay period has elapsed. Also the mechanism disclosed in British Patent Specification No. 1,144,992 is only effective to delay actuation of the respective switch when the rate of change of the working fluid pressure is high, there is no delay when the rate of change of the working fluid pressure is low.

An object of this invention is to provide a pressure responsive switch actuating mechanism which, whilst being particularly suitable for controlling operation of a switch in the cutter driving power circuit of a coal shearing machine so that that circuit is interrupted whilst the water pressure is being built up to the pressure necessary to form an effective spray and for a predetermined time interval after that pressure is established whereafter the cutter driving power circuit is made automatically, is generally applicable to an application in which a switch is to be controlled by being held in one condition whilst a working fluid pressure changes from ambient pressure to a predetermined pressure and for a predetermined time interval after that pressure is established whereafter the condition of the switch is changed automatically by operation of the mechanism; the mechanism incorporating mechanical means effective to delay actuation of the switch for the predetermined time interval after establishment of the pressure at which it is to be actuated, being arranged so as to avoid operation of the time delay mechanism before the pressure at which the switch is to be actuated has been established and being unresponsive to the rate of change of the working pressure so that there is always a time delay after establishment of the pressure at which the switch is to be operated before it is operated.

According to this invention there is provided a pressure responsive switch actuating mechanism including a movable actuating element which is movable between an inoperative location and an operative location to actuate the switch, and a pressure responsive system including a movable stop against which the movable actuating element is normally urged, the pressure responsive system being operable to control movement of the movable actuating element by controlling location of the movable stop in accordance with a working pressure to which it is adapted to respond, there being a time delay mechanism which operates to delay movement of the movable actuating element following movement of the movable stop in response to certain pressure changes, wherein the pressure responsive system is set in one condition in which it locates the movable stop in one location when the working fluid pressure is within a range bounded by ambient pressure and a predetermined switching pressure, even when that working fluid pressure is changing, and is convertible to another condition with a snap action to move the movable stop to another location when the working fluid pressure reaches the predetermined switching pressure whereby the movable actuating element is released for delayed movement into abutment with the movable stop at the other location to actuate the switch.

Preferably the time delay mechanism does not operate to delay movement of the movable actuating element which follows movement of the movable stop from the other location to said one location so that the movable actuating element is returned promptly to its inoperative location in the event that the working fluid pressure should cease to be a pressure necessary to maintain the pressure responsive system in its other condition. The pressure at which the movable actuating element is returned to its inoperative location is preferably nearer ambient pressure than is said predetermined switching pressure so that operation of the pressure responsive system exhibits an hysteresis effect.

The preferred form of pressure responsive system comprises a movable wall to one side of which the working fluid pressure is subjected, a link which is pivotally joined to the other side of the wall and which extends therefrom oblique to the line of action of the fluid pressure loading on the wall, and resilient means acting on the link at a location thereon spaced from the wall and along a line transverse to said line of action whereby to tend to reduce the angle included between the link and said line of action, the arrangement being such that there is virtually no movement of said location on the link until said predetermined switching pressure is established, a large rapid movement of said location on the link when said predetermined switching pressure is established and a snap back of said location if the pressure falls significantly below said predetermined switching pressure. Such an arrangement has the hysteresis characteristic that the pressure required to initiate the large rapid movement of said location on the link is greater than that required subsequently to prevent snap back of said location.

The link may be one link element of a buckling link which is a linkage comprising two link elements hinged together, a first of the link elements (namely the other link element) being anchored at a location spaced from the hinge, and wherein yieldable biassing means (namely said resilient means) exert a biassing load which opposes relative angular movement of the two link elements away from one another whereby the two link elements are held against such relative angular movement in reaction to an externally applied load (namely the working fluid pressure loading) which is less than a predetermined buckling load, the arrangement being such that the yieldable biassing means yield when said predetermined buckling load is applied and the linkage buckles with a snap action at the hinge so that the two link elements move away from one another angularly about the hinge. Conveniently the other link element is anchored by having its end remote from said one link element pinned to a fixed pivot mount. The resilient means conveniently comprise a coil spring.

The preferred form of time delay mechanism comprises a spring dashpot system which is provided with a one-way valve to allow quick return of the movable actuating element to its inoperative location.

The mechanism may be arranged for operation at each of a range of predetermined switching pressures, the loading of the spring that serves as said resilient means being adjusted for each predetermined switching pressure so that the loading is increased as the predetermined switching pressure is increased. Preferably the effective spring rate of the coil spring that serves as said resilient means is increased as the loading of that coil spring is increased to increase the predetermined switching pressure.

The end remote from the movable wall of the link may be pivotally connected to a lever at one location on that lever which is spaced from the fulcrum of the lever, and the coil spring may be coupled to the lever at another location which is spaced from the fulcrum, the effective spring rate being adjusted by altering the distance between the lever fulcrum and that other location at which the spring is coupled to the lever. Preferably the spring is coupled to a selected one of a group of other locations, each spaced from the fulcrum by a distance which differs from the distance between each of the other locations of the group and the fulcrum. Increasing the effective spring rate as the predetermined switching pressure is increased has the advantage that the differential between the predetermined switching pressure and the pressure at which snap back of said link occurs is less likely to be excessive at higher switching pressures.

Where the link is one link element of a buckling link, the buckling link is preferably arranged so that its two link elements reach against said other side of the movable wall at their common pivot connection and are both oblique to said line of action of the fluid pressure loading on the movable wall that passes between them. The loading of the coil spring is less than would be necessary if that spring was arranged to act at the pivot connection between the two link elements of the buckling link where the end of said one link element remote from the hinge is pivotally connected to the movable wall. Furthermore there is no need for a rolling guide to be provided for said one link element if the link elements are arranged as is preferred. Conveniently the angle included between the other link element of the buckling link and said line of action of the fluid pressure loading on the movable wall is less than a right angle and is arranged so that there is minimal movement of the common pivot point laterally relative to said line of action of the fluid pressure loading on the movable wall. Preferably the angle included between said other link element and said line of action of the fluid pressure loading on the movable wall is greater than the angle included between said one link element of the buckling link and said line of action of the fluid pressure loading on the movable wall.

The movable wall conveniently comprises a piston with a rolling diaphragm seal. There may be further resilient means which are carried by said movable wall in such a manner that they are moved freely into abutment with a co-operating fixed abutment by initial movement of said movable wall that follows the application of said predetermined switching pressure to that movable wall whereafter they react against said fixed abutment and oppose further movement of said movable wall in the direction of said initial movement. Provision of such further resilient means leads to the rate of rise of the effective pressure force being less than would be the case if no such further resilient means were provided.

Figure 2:
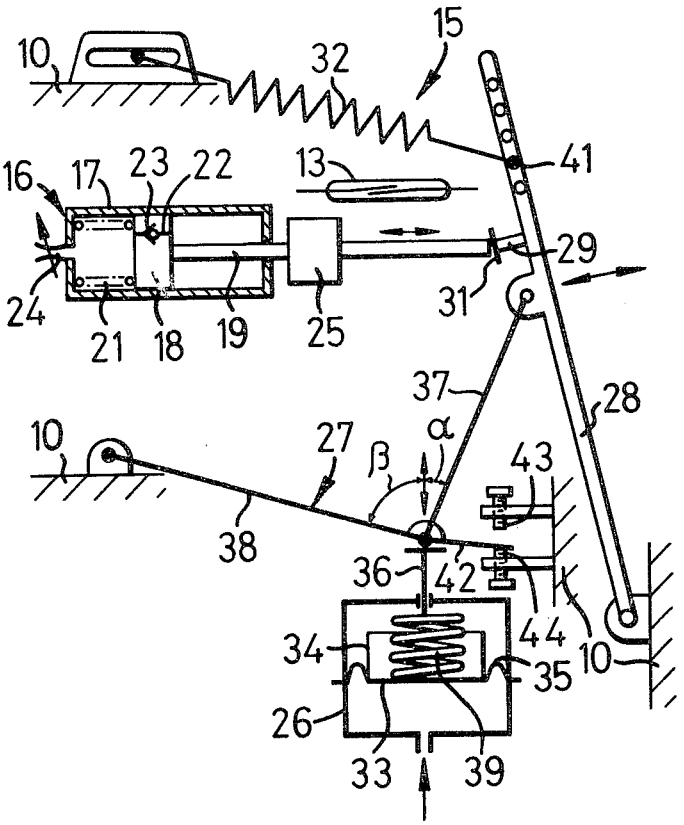

One form of pressure responsive switch actuating mechanism in which this invention is embodied is described now by way of example with reference to the accompanying drawings; of which:

FIG. 1 is a schematic view in perspective of apparatus which includes the mechanism and a flow switch; and FIG. 2 is a diagrammatic illustration of the pressure responsive mechanism that is incorporated in the apparatus shown in FIG. 1 and shows the mechanism in its inoperative state.

FIG. 1 shows a casing 10 having a bore 11 formed through it. A flow responsive switch 12 and a pressure responsive switch 13 are housed in the casing 10. The switches 12 and 13 are reed switches. The flow responsive switch 12 is adapted to respond to fluid flow through the bore 11 and includes a flow responsive actuating arrangement 14 in the bore 11. An actuating mechanism 15 for the pressure responsive switch 13 is housed in the casing 10 and is adapted to respond to the pressure in the bore 11.

The mechanism 15 comprises a dashpot 16 which comprises a cylinder 17 (see FIG. 2) having a piston 18 sliding in it. A rod 19 is fixed at one end to the piston 18 and projects from one end of the dashpot cylinder casing. A spring 21 within the dashpot cylinder 17 acts on the dashpot piston 18 and urges it towards the end of the dashpot casing from which the rod 19 projects. The piston 18 has a passage 22 of unrestricted dimensions formed in it, there being a one way valve 23 which prevents air flow through the passage 22 as the piston 18 moves in the direction in which it is urged by the spring 21 and which allows unrestricted air flow through that passage 22 in the opposite direction. The interior of the cylinder 17 communicates with the surrounding atmosphere via a passage 24 of restricted dimensions which is formed through the end wall at the other end of the cylinder 17. The restriction in the passage 24 is variable. Hence movement of the piston 18 in the direction in which it is urged by the spring 21 is damped and, apart from the resistance applied by the spring 21, is substantially unrestricted in the opposite direction.

The rod 19 carries a magnet 25. The end of the rod 19 remote from the dashpot 16 co-operates with a pressure responsive system which comprises a fluid pressure servo motor 26, a bistable mechanism such as a buckling link 27, a lever 28, an abutment rod 29 which is fixed to the lever 28 and which carries a stop 31 which is aligned with the movable rod 19, and a tension coil spring 32.

The servo motor 26 comprises a cylinder casing which is divided internally into two chambers by a movable wall 33 which comprises a piston 34 with a rolling diaphragm seal 35. A rod 36 is fixed at one end to the piston 34 and extends from the piston 34 through one end of the servo motor cylinder casing. The end of the rod 36 outside the servo motor casing is pinned to the common pivot joint between the two link elements 37 and 38 of the buckling link 27. The chamber of the servo motor 26 opposite the rod 36 is in communication with the bore 11 so that the pressure of fluid in the bore 11 acts on the movable wall 33 to urge the rod 36 out of the servo motor casing. A compression spring 39 surrounds the rod 36 within the servo motor casing and has one end turn abutting the piston 34.

FIG. 1 shows that the axis of the rod 36 is substantially vertical, the rod 36 projecting upwards from the servo motor casing. The buckling link 27 is above the servo motor 26 and the axis of the rod 36 extends between its link elements 37 and 38. One link element, viz. the link element 37, of the buckling link 27 is pinned to the lever 28 and extends upwards along a line which is oblique to the axis of the rod 36. The acute angle $\alpha$ that is included between the link element 37 and the axis of the rod 36 is smaller than the acute angle $\beta$ that is included between the other link element 38 and the axis of the rod 36. The other end of the other link element 38 is hinged to the casing 10. The angle included between that other link element 38 and the horizontal is small so that there is little lateral movement of the pin joint between the link elements 37 and 38, relative to the axis of the rod 36, with angular movement of that other link element 38.

One end of the tension spring 32 is anchored to the casing 10 at a location substantially vertically above the fixed hinge point for the other end of the other buckling link element 38. The other end of the tension spring 32 is joined to the lever 28 by a pin 41 which is spigotted into a selected one of a range of six spigot holes formed in the lever 28. FIG. 1 shows that the axis of the servo motor rod 36, the pivots at the ends of the buckling link 27 as well as the common pivot of the buckling link 27 and the couplings at the ends of the tension spring 32 all lie substantially in a common vertical plane.

The pressure responsive reed switch 13 extends alongside the rod 19 which, in combination with the magnet 25, comprise a movable actuating element for the reed switch 13.

FIG. 2 shows that an arm 42 which is fixed to one of the buckling link elements 37 and 38 projects between a pair of vertically-spaced stops 43 and 44. Hence the range of movement of the buckling link elements 37 and 38 and of the common pivot between them is limited by the distance between the stops 43 and 44. It is apparent from inspection of FIG. 2 that the range of movement of the buckling link elements 37 and 38 is relatively small and is not sufficient for the buckling link 27 to go 'over centre' in the manner of a toggle mechanism. The common pivot of the buckling link 27, with which the rod 36 coacts, always stays to one side of centre, that is to say to one side of the line that joins the outer ends of the link elements 37 and 38. FIG. 1 shows a pointer 45 fixed to the upper end of the lever 28 and co-operating markings on the casing 10 around a window 46 in the casing 10.

In the inoperative condition of the mechanism 15, as shown in the drawings, the magnet 25 of the movable actuating element is held out of alignment with the reed switch 13 by the action of the coil spring 32 which acts through the lever 28 and the stop 31 to urge the movable actuating element against the action of the dashpot coil spring 21 on the rod 19. There is a clearance between the compression spring 39 and the nearer end wall of the servo motor casing. The arm 42 abuts the lower stop 44.

The inoperative condition is maintained as the pressure of the fluid pressure system, and hence the pressure in the lower chamber of the servo motor 26 builds up towards the switching pressure, that is the pressure at which the switch 13 is to be tripped. The force exerted by the coil spring 32 through the lever 28, the buckling link 27 and the rod 36 on the movable wall 33 of the servo motor 26 is sufficient for there to be virtually no movement of that movable wall 33 and hence virtually no movement of the link elements 37 and 38 of the buckling link 27, the lever 28 and the stop 31 against the action of the coil spring 32 until the switching pressure is established in the lower chamber of the servo motor 26.

The coil spring 32 yields when the switching pressure is established in the lower chamber of the servo motor 26, the accompanying movement of the movable wall 33 that is transmitted to the common pivot of the buckling link 27 via the rod 36, causes a rapid increase in the angle included between the link elements 37 and 38 of the buckling link 27 and rapid movement of the lever 28 and hence of the stop 31 away from the dashpot 16 until that movement is stopped by abutment of the arm 42 with the upper stop 43. The movement of the link elements 37 and 38 of the buckling link 27 occurs with a snap action. After a limited unimpeded movement of the movable wall 33 upwards, the compression spring 39 abuts the upper end wall of the servo motor casing so that the remainder of the upwards movement of the movable wall 33, and the following movement of the buckling link elements 37 and 38, the lever 28 and the stop 31 is impeded by the action of the compression spring.

The movable actuating element follows such movement of the stop 31, due to the action of the dashpot spring 21 on the rod 19, but it separates from the stop 31 and lags behind the stop 31 due to the restriction on flow of air into the dashpot cylinder 17 provided by the passage 24 of flow restricting dimensions. Such following movement of the movable actuating element is arrested by abutment of the rod 19 with the stop 31 and, towards the end of that movement, the magnet 25 is moved into the location adjacent the reed switch 13 in which it acts to make the contacts of that switch 13.

The dimensions and arrangement of the various parts of the mechanism 15, especially their location in the inoperative condition of the mechanism 15, and the characteristics of the spring/dashpot system are selected so that the time interval between the switching pressure being established in the servo motor 26 and the contacts of the reed switch 13 being made is predetermined.

If at any time the pressure of the fluid pressure system falls significantly below the switching pressure, the lever 28 and the stop 31 fixed to it will be moved rapidly back to the location they adopt in the inoperative condition of the mechanism 15 by the movement of the movable wall 33 which is transmitted to the lever 28 via the buckling link 27, due to the action of the coil spring 32. The one-way valve 23 in the passage 22 of unrestricted dimensions in the dashpot piston 18 enables this movement to be imparted to the movable rod 19 without significant resistance by the dashpot 16 so that the magnet 25 is displaced from the reed switch 13 and the circuit through the reed switch 13 is broken. Hence the time delay machanism is zeroed. The pressure at which the lever 28 and the stop 31 are moved back is lower than the switching pressure (say 10% lower) so that the mechanism 15 exhibits hysteresis effect characteristics in its operations.

The time delay setting can be adjusted by relocating the reed switch 13 relative to the dashpot 16. The switching pressure can be altered by changing the selected one of the number of holes in the lever 28 to which the spring 32 is coupled.

The pointer 45 co-operates with markings on the casing 10 to provide a visual indication of the state of the mechanism 15.

The snap action operation of the pressure responsive mechanism 15 and the hysteresis effect characteristics of the system can be optimised for a given switching pressure by optimising the relationship between the forces exerted by the springs 21 and 32, the length of the link element 37 and the effective area of the servo motor 26.

Various modifications of the preferred embodiment of this invention just described and other embodiments are conceivable for use in certain circumstances. The buckling link may be arranged so that the resilient means act at its hinge which is spaced from the movable wall, the end of said one link element remote from the hinge being pinned to the movable wall; or a single link may be used instead of the buckling link, there being a roller at either end of the link and running on a suitable reaction surface. A bellows mechanism may be used instead of the servo motor and the dashpot 16 may be replaced by a liquid-filled dashpot with a passage of restricted dimensions being formed in the piston.

I claim:

1. A pressure responsive switch actuating mechanism including a movable actuating element which is movable between an inoperative location and an operative location to actuate the switch, and a pressure responsive system including a movable stop against which the movable actuating element is normally urged, the pressure responsive system being operable to control movement of said movable actuating element by controlling location of the movable stop in accordance with the fluid pressure to which said movable stop is subjected, there being a time delay mechanism which operates to delay movement of said movable actuating element following movement of said movable stop in response to certain pressure changes, wherein the improvement comprises a bistable mechanism responsive to pressure of a flow of fluid, said bistable mechanism comprising a movable wall having one side to which the fluid pressure is subjected is subjected, and a plurality of links movable by said movable wall which causes movement of the stop, said mechanism having only two stable conditions and which moves rapidly to either of those stable conditions when displaced from one to the other one, the bistable mechanism including a compression spring which bias said bistable mechanism to one of its two stable conditions so that the pressure responsive system is set in one condition in which it locates said movable stop in one location when the working fluid pressure is within a range bounded by ambient pressure and a predetermined switching pressure even when the fluid pressure is changing and is convertible rapidly to another condition so as to move said movable stop rapidly to another location when the fluid pressure reaches said predetermined switching pressure at which said yieldable biassing means yields whereby said movable actuating element is released for delayed movement into abutment with said movable stop at said other location to actuate said switch.

2. A pressure responsive switch actuating mechanism according to claim 1, wherein the movable wall comprises a piston with a rolling diaphragm seal.

3. A pressure responsive switch actuating mechanism according to claim 1, including further resilient means which are carried by said movable wall in such a manner that they are moved freely into abutment with a co-operating fixed abutment by initial movement of said movable wall that follows the application of said predetermined switching pressure to that movable wall whereafter they react against said fixed abutment and oppose further movement of said movable wall in the direction of said initial movement.

4. A pressure responsive switch actuating mechanism according to claim 1, wherein the time delay mechanism does not operate to delay movement of said movable actuating element which follows movement of said movable stop from said other location to said one location so that the switch actuating element is returned promptly to its inoperative location in the event that the working fluid pressure should cease to be a pressure necessary to maintain the pressure responsive system in said other condition.

5. A pressure responsive switch actuating mechanism according to claim 1, wherein the pressure at which the movable actuating element is returned to its inoperative location is nearer ambient pressure than is said predetermined switching pressure so that operation of the pressure responsive system exhibits an hysteresis effect.

6. A pressure responsive switch actuating mechanism according to claim 1, wherein said bistable mechanism comprises a link which is arranged to react against the other side of the movable wall and which extends therefrom oblique to the line of action of the fluid pressure loading on the wall, and said yieldable biassing means comprise resilient means acting on the link at a location thereon spaced from the wall and along a line transverse to said line of action whereby to tend to reduce the angle included between the link and said line of action, the arrangement being such that there is virtually no movement of said location on the link until said predetermined switching pressure is established, a large rapid movement of said location on the link when said predetermined switching pressure is established and a snap back of said location if the pressure falls significantly below said predetermined switching pressure.

7. A pressure responsive switch actuating mechanism according to claim 6, wherein the link is one link element of a buckling link which is a linkage comprising two link elements hinged together, the other link element being anchored at a location spaced from the hinge, and said resilient means that exert a biassing load which opposes relative angular movement of the two link elements whereby the two link elements are held against relative angular movement in reaction to the fluid pressure loading on the wall when that loading is less than a predetermined buckling load which is the fluid pressure loading on the wall when said predetermined switching pressure is established, the arrangement being such that the resilient means yield when said predetermined buckling load is applied to the linkage and the linkage buckles with a snap action at the hinge so that the two link elements move away from one another angularly about the hinge.

8. A pressure responsive switch actuating mechanism according to claim 6, wherein the resilient means comprise a coil spring and means are provided for adjusting the loading of the coil spring to a selected one of a range of spring loads each appropriate for a respective one of a range of predetermined switching pressures at which the mechanism is arranged to operate.

9. A pressure responsive switch actuating mechanism according to claim 8, wherein the effective spring rate is increased as the loading of that coil spring is increased to increase the predetermined switching pressure.

10. A pressure responsive switch actuating mechanism according to claim 9, wherein the end remote from the movable wall of the link is pivotally connected to a lever at one location on that lever which is spaced from the fulcrum of the lever, and the coil spring is coupled to the lever at another location which is spaced from the fulcrum, the effective spring rate being adjusted by altering the distance between the lever fulcrum and that other location at which the spring is coupled to the lever.

11. A pressure responsive switch actuating mechanism according to claim 10, wherein the spring is coupled to a selected one of a group of other locations, each spaced from the fulcrum by a distance which differs from the distance between each of the other locations of the group and the fulcrum.

12. A pressure responsive switch actuating mechanism according to claim 9, wherein the link is one link element of a buckling link which is a linkage comprising two elements hinged together, the other link element being anchored at a location spaced from the hinge, and said coil spring that exerts a biassing load which opposes relative angular movement of the two link elements away from one another whereby the two link elements are held against such relative angular movement in reaction to the fluid pressure loading on the wall when that loading is less than a predetermined buckling load which is the fluid pressure loading on the wall when said predetermined switching pressure is established, the two link elements being arranged to react at their hinge connection against said other side of the movable wall and being both oblique to said line of action of the fluid pressure loading on the movable wall that passes between them, the arrangement being such that the coil spring yields when said predetermined buckling load is applied to the linkage and the linkage buckles with a snap action at the hinge so that the two link elements move away from one another angularly about the hinge.

13. A pressure responsive switch actuating mechanism according to claim 12, wherein the angel included between the other link element of the buckling link and said line of action of the fluid pressure loading on the movable wall is less than a right angle and is arranged so that there is minimal movement of the common pivot point laterally relative to said line of action of the fluid pressure loading on the movable wall.

14. A pressure responsive switch actuating mechanism according to claim 13, wherein the angle included between said other link element and said line of action of the fluid pressure loading on the movable wall is greater than the angle included between said one link element of the buckling link and said line of action of the fluid pressure loading on the movable wall.

15. A pressure responsive switch actuating mechanism according to claim 12, including a pair of fixed stops which are spaced apart and an arm which is fixed to one of the buckling link elements and which projects between the fixed stops so that movement of the buckling link elements in either direction is limited by abutment of the arm with a respective one of the fixed stops, the distance between the fixed stops being sufficiently small to ensure that the range of movement of the buckling link elements and the common hinge between them is less than enough for the buckling link to go 'over centre'.

16. A switch actuating mechanism including a movable actuating element which is movable between an inoperative location and an operative location to actuate a switch; a pressure responsive system including a movable stop, urging means urging the actuating element towards the stop whereby the actuating element is normally urged against the stop, means responsive to pressure of a flow of fluid comprising a movable wall having one side to which the fluid pressure is subjected and means by which movement of the movable wall causes movement of the stop whereby the location of the stop is controlled in accordance with the fluid pressure, said means by which movement of the movable wall causes movement of the stop comprising a rigid link which has one end cooperating with the other side of the wall so that it moves with the wall when the wall moves and which extends away from the wall oblique to a line of action of the fluid pressure loading on the wall, resilient means which exert a load which is applied to the link at a location thereon spaced from said one end, whereby the tend to reduce the angle included between the link and said line of action, and constraining means which, in conjunction with the wall and the resilient means, constrain the link against movement relative to the wall when the wall is stationary so that the system is static and the fluid pressure loading on the wall overcomes the counterload applied thereto by the resilient means acting through the link; and a time delay mechanism which is operable to delay movement of the actuating element following movement of the stop in response to certain pressure changes; the pressure responsive system being set in one condition in which it locates said stop in one location when the fluid pressure is within a range bonded by ambient pressure and a predetermined switching pressure, even when the fluid pressure is changing, and being convertible to another condition to move said stop to another location when the fluid pressure reaches said predetermined switching pressure whereby said actuating element is released for delayed movement into abutment with said stop at said other location to actuate said switch, there being virtually no movement of said location on the link until said predetermined switching pressure is established, a large rapid movement of said location on the link when said predetermined switching pressure is established and a snap back to said location if the pressure falls significantly below said switching pressure.

17. A switch actuating mechanism including a movable actuating element which is movable between an inoperative location and an operative location to actuate a switch; a pressure responsive system including a movable stop, urging means urging the actuating element towards the stop whereby the actuating element is normally urged against the stop, means responsive to pressure of a flow of fluid comprising a movable wall having one side to which the fluid pressure is subjected, means by which movement of the movable wall causes movement of the stop whereby the location of the stop is controlled in accordance with the fluid pressure, said means by which movement of the movable wall causes movement of the stop comprises a buckling link which is a linkage comprising two link elements hinged together, one of the link elements having one end cooperating with the other side of the wall so that it moves with the wall when the wall moves, and extending away from the wall oblique to a line of action of the fluid pressure loading on the wall, the other link element being anchored at a location spaced from the hinge, and resilient means which exert a load which is applied to said one link element at a location thereon spaced from said one end whereby to tend to reduce the angle included between said one link element and said line of action and thereby to hold the two link elements against movement relative to the wall when the wall is stationary so that the system is static and the fluid pressure loading on the wall overcomes the counterload applied thereto by the resilient means acting through said one link element, a pair of fixed stops which are spaced apart, and an arm which is fixed to one of the buckling link elements and which projects between the fixed stops so that movement of the buckling link elements in either direction is limited by abutment of the arm with a respective one of the fixed stops, the distance between the fixed stops being sufficiently small to ensure that the range of movement of the buckling link elements and the common hinge between them is less than enough for the buckling link to go 'over centre'; and a time delay mechanism which is operable to delay movement of the actuating element following movement of the stop in response to certain pressure changes; the pressure responsive system being set in one condition in which it locates said stop in one location when the fluid pressure is within a range bounded by ambient pressure and a predetermined switching pressure even when the fluid pressure is changing and being convertible to another condition to move said stop to another location when the fluid pressure reaches said predetermined switching pressure whereby said actuating element is released for delayed movement into abutment with said stop at said other location to actuate said swtich, there being virtually no movement of said location on the link until said predetermined switching pressure is established, a large rapid movement of said location on the link when said predetermined switching pressure is established and a snap back of said location if the pressure falls significantly below said switching pressure.

* * * * *